US006556191B1

(12) United States Patent
Ouchi

(10) Patent No.: US 6,556,191 B1
(45) Date of Patent: Apr. 29, 2003

(54) IMAGE DISPLAY APPARATUS, NUMBER OF HORIZONTAL VALID PIXELS DETECTING APPARATUS, AND IMAGE DISPLAY METHOD

(75) Inventor: Akihiro Ouchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 188 days.

(21) Appl. No.: 09/688,870

(22) Filed: Oct. 17, 2000

(30) Foreign Application Priority Data

Oct. 18, 1999 (JP) ..... 11-295697

(51) Int. Cl.[7] ..... G09G 5/00
(52) U.S. Cl. ..... 345/204; 345/213; 345/55
(58) Field of Search ..... 345/87, 204, 211, 345/213, 99, 581; 348/540

(56) References Cited

U.S. PATENT DOCUMENTS 5,790,083 A * 8/1998 Bassetti ..... 345/3.1
5,821,910 A * 10/1998 Shay ..... 345/99
5,841,430 A * 11/1998 Kurikko ..... 345/213
5,847,701 A * 12/1998 Eglit ..... 345/204
6,043,803 A * 3/2000 Shimizu ..... 345/581
6,337,682 B1 * 1/2002 Hwang ..... 345/213

FOREIGN PATENT DOCUMENTS

JP 10-78771 3/1998

* cited by examiner

*Primary Examiner*—Richard Hjerpe
*Assistant Examiner*—Francis Nguyen

(57) ABSTRACT

An image display apparatus has an input dot clock reproducing circuit for reproducing an input dot clock on the basis of an input horizontal synchronizing signal of an input image signal, an A/D converting circuit for converting the input image signal into a digital signal in response to the input dot clock, and an image display unit drive circuit for converting the digital signal into a display signal which is suitable for display by an image display unit and generating a drive timing signal for the display. A number of horizontal valid pixels detecting circuit detects the number of horizontal valid pixels of the display signal on the basis of the display signal and the drive timing signal, and an input dot clock control circuit for controlling the frequency of the input dot-clock so that the number of horizontal valid pixels is equal to a desired value.

17 Claims, 6 Drawing Sheets

IMAGE DISPLAY APPARATUS, NUMBER OF HORIZONTAL VALID PIXELS DETECTING APPARATUS, AND IMAGE DISPLAY METHOD

BACKGROUND OF THE INVENTION

1. Field of the Invention

The present invention relates to an image display technique, and more particularly, to a proper dot clock reproducing technique when converting an analog video signal from a video signal output device such as a personal computer into a digital video signal and outputting the converted signal to a dot-matrix type image display apparatus, and to a technique that is applied to and is suitable for use in a multi-scan type liquid crystal display, a liquid crystal projector, and a plasma display, etc. to which a video signal according to an unspecified standard is inputted.

2. Description of the Related Art

In recent years, the most common image display apparatus of computers, etc. is a so-called multi-scan type image display apparatus capable of displaying an image signal having various frequencies (resolutions). In order to realize a multi-scan type image display apparatus using dot-matrix type image display apparatuses, typically, for example, liquid crystal displays and plasma displays, it is necessary to sample an analog image signal at a dot clock which coincides with a dot period of the image signal, to write the sampled signals into a memory, and to perform processes such as enlargement/reduction of the image so as to match the image with the resolution of an image display unit and other signal processing. Here, assuming that the image signal is sampled at a dot clock which is different from the frequency of an input image signal, not only is the number of horizontal valid pixels after sampling different from the number of horizontal valid pixels to be displayed on the image display unit, but also this causes phenomena such as moire fringes, etc., and thus the image quality deteriorates noticeably. However, since the image signal of the source which outputs the dot clock is small, the dot clock is reproduced by gradually multiplying the horizontal synchronizing signal in the image display apparatus. Therefore, it is necessary to provide a mechanism for positively reproducing the dot clock so that the input image signal is displayed without deterioration in the quality of the image.

A conventional image display apparatus adopts a method of determining the resolution of an image signal which is connected by using a horizontal synchronizing signal and a vertical synchronizing signal of an inputted image signal and determining a multiple for the gradual reduction of the dot clock from the determined result by referring to a table which is prepared in advance. However, the dot clock differs slightly from the prepared dot clocks depending on the connected source of the image signal and, in this case, the dot clock frequency is adjusted by manual adjustment while a user visually checks the displayed image.

Japanese Patent Laid-Open No. 10-078771 discloses an image display apparatus in which the manual adjustment is automated. FIG. 7 shows a construction of a dot clock generating device in the image display apparatus. Referring to FIG. 7, there is provided a sampling circuit 5 for sampling a video signal from a video output unit 2; a sampling clock generating circuit 7 for generating a sampling clock; a clock phase varying circuit 6; an image holding memory 4 for generating a clock; a phase control unit 8; a clock frequency control circuit 9 for controlling the frequency of the sampling clock which is generated by the sampling clock generating circuit 7; and a video output control unit 3. Those components form a dot clock generating device 1. An image display apparatus 13 has the dot clock generating device 1 and an image display circuit 14, and displays a video signal which is digitally converted by use of the sampling clock via the image display circuit 14.

In the construction, the video output unit 2 outputs a video signal including an image for generating the sampling clock which has a predetermined number of dots. Then, the clock frequency control circuit 9 counts the output period of the image for generating the sampling clock of the video signal by a clock having a proper period with a frequency higher than that of the dot clock of the video signal, thereby detecting the number of clock pulses for a one-dot period as [(the number of clock pulses for an n-dot period)/(the number of dots n)=(the number of clock pulses for one horizontal scanning period)]. Further, the number of clock pulses for one horizontal scanning period is counted, thereby obtaining the total number of dots for one horizontal scanning period as [(the number of clock pulses for one horizontal scanning period)/(the number of clock pulses for a one-dot period)=(the total number of dots for one horizontal scanning period)]. The obtained number is set in a dividing counter in the clock generating circuit 7, thereby automatically adjusting the frequency of the sampling clocks to the desired dot clock frequency.

However, according to the conventional image display apparatus in which the dot clock frequency is manually adjusted, a user must manually adjust the displayed image while viewing the displayed image when the dot clock frequency of the source of the image signal differs slightly from the dot clock frequency which is reproduced by the image display apparatus. Thus, this causes a problem in that not only does the operation become complicated but also it is difficult to accurately adjust the displayed image.

Also, according to the image display apparatus disclosed in Japanese Patent Laid-Open No. 10-078771, although the automatization of adjustment is realized, it is necessary to output an image signal for adjustment from the source of the image signal. Further, since a detection clock having a frequency higher than that of the dot clock of the input image signal is necessary so as to detect the total number of dots for one horizontal scanning period, the construction of the clock frequency control circuit must cope with an excessively high frequency and this results in the problem of increased costs.

SUMMARY OF THE INVENTION

In order to solve the above-mentioned problems, it is an object of the present invention to provide an image display apparatus capable of automatically adjusting a dot clock frequency without needing a specified image signal for adjustment and to provide an image display method. Further, it is an object of the present invention to provide an image display apparatus having a construction by which an operating speed of a circuit for adjusting a dot clock frequency is increased and costs are easily reduced, and to provide an image display method.

To accomplish the objects, according to a first aspect of the present invention, there is provided an image display apparatus for displaying an image to a dot-matrix type image display unit on the basis of an input image signal having an arbitrary standard, including an input dot clock reproducing circuit for reproducing an input dot clock on the basis of an input horizontal synchronizing signal of the input image signal, an A/D converting circuit for converting the input image signal into a digital signal in response to the input dot clock, an image display unit drive circuit for converting the digital signal into a display signal which is suitable to display by the image display unit and generating a drive timing signal for the display, a detecting circuit of the number of horizontal valid pixels for detecting the number of horizontal valid pixels of the display signal on the basis of the display signal and the drive timing signal, and an input dot clock control circuit for controlling a frequency of the input dot-clock so that the number of horizontal valid pixels is equal to a desired value.

Preferably, in the image display apparatus, the image display unit drive circuit comprises an image memory for temporarily storing the digital signal and generates a display horizontal synchronizing signal, a display vertical synchronizing signal, and a display dot-clock as the drive timing signals.

Preferably, in the image display apparatus, the image display unit drive circuit converts the digital signal into the display signal so that the numbers of horizontal and vertical pixels of the digital signal coincide with the numbers of horizontal and vertical pixels of the image display unit.

Preferably, in the image display apparatus, the input dot clock reproducing circuit includes a phase comparing circuit for comparing a phase of the input horizontal synchronizing signal with a phase of an internal feed-back signal and for outputting an error signal, a filter circuit for smoothing the output of the phase comparing circuit, a voltage control oscillating circuit for controlling an oscillating frequency by an electric potential which is smoothed by the filter circuit, and a 1/N-dividing circuit for dividing an oscillating signal of the voltage control oscillating circuit into N, thereby generating the internal feed-back signal.

Preferably, in the image display apparatus, the input dot clock control circuit obtains the desired number of horizontal valid pixels by controlling a dividing number N of the 1/N-dividing circuit.

Preferably, in the image display apparatus, the detecting circuit of the number of horizontal valid pixels detects a horizontal start position of the display signal as the number of displayed dot clocks until a valid display image signal is detected for each display horizontal scanning period and also detects a horizontal end position of the display signal as the number of displayed dot-clocks until the valid display image signal is not detected for each display horizontal scanning period.

Preferably, in the image display apparatus, the input dot clock control circuit has a CPU.

According to a second aspect of the present invention, there is provided an apparatus for detecting the number of horizontal valid pixels, including a dot clock counting circuit for starting counting of the number of dot clocks of an image signal to be inputted synchronously with a horizontal synchronizing signal of the image signal, a level detecting circuit for detecting whether or not there is a valid image signal in the image signal, a horizontal image start-position latching circuit for latching a minimum counted-number of the dot clocks until the valid image signal is detected for each horizontal scanning period of the image signal, and a horizontal image end-position latching circuit for latching a maximum counted-number of the dot clocks until the valid image signal is not detected for each horizontal sampling period of the image signal.

According to a third aspect of the present invention, there is provided an image display method for displaying an input image signal to an image display unit by use of a display dot-clock by sampling the input image signal by an input dot clock and by converting the signal into a display signal suitable to display to the image display unit, including the steps of detecting horizontal start and end positions of a valid signal in the converted display signal as the numbers of displayed dot-clocks until the valid display signal is detected and is not detected for each display horizontal scanning period, and controlling a frequency of the input dot-clock so that the number of horizontal valid pixels which is obtained on the basis of the detected result is equal to the desired value.

Preferably, the image display method further includes the steps of generating the input dot clock by an input dot clock reproducing circuit for generating a dot clock by converting an input horizontal synchronizing signal of the input image signal into a signal of a frequency corresponding to a dividing set value, and controlling a frequency of the input dot clock by adding a difference between the number of horizontal valid pixels which is obtained on the basis of the detected result and the desired number of horizontal valid pixels to the dividing set value.

Preferably, the image display method further includes the steps of generating the input dot clock by an input dot clock reproducing circuit for generating a dot clock by converting an input horizontal synchronizing signal of the input image signal into a signal of a frequency corresponding to a dividing set value, and controlling a frequency of the input dot-clock by multiplying the dividing set value by a ratio of the number of horizontal valid pixels which is obtained on the basis of the detected result to the desired number of horizontal valid pixels.

Preferably, according to the construction of the present invention, the number of horizontal valid pixels is detected on the basis of the display signal suitable to display to the image display unit, and the frequency of dot clocks is controlled so that the number of horizontal valid pixels is equal to a desired value. Therefore, the input dot clock is adjusted without needing the conventional manual adjustment and the image signal for adjustment. The number of horizontal valid pixels is detected by the displayed dot-clock which is used for display of the image display unit and, thus, it is unnecessary to use a circuit corresponding to a conventional remarkably higher frequency for the purpose of the detection of the number of horizontal valid pixels.

Further objects, features, and advantages of the present invention will become apparent from the following description of the preferred embodiments with reference to the attached drawings.

DESCRIPTION OF THE PREFERRED EMBODIMENTS

Figure 1:
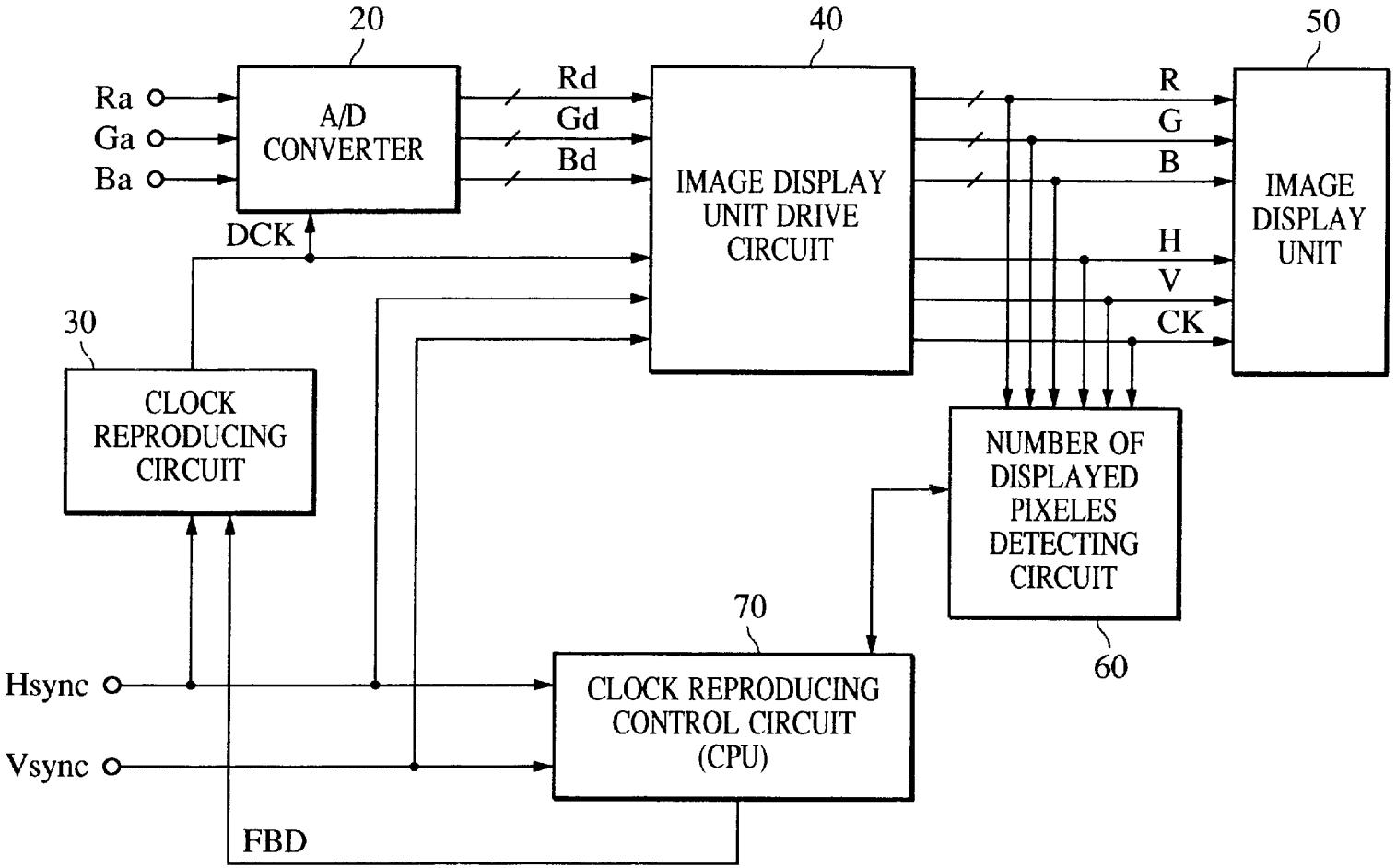
FIG. 1 is a block diagram showing the construction of an image display apparatus according to one embodiment of the present invention.

FIG. 1 is a block diagram showing the construction of an image display apparatus according to one embodiment of the present invention. As shown in FIG. 1, the image display apparatus comprises an A/D converter 20 for converting analog image input signals $R_a$, $G_a$, and $B_a$ into digital image signals $R_d$, $G_d$, and $B_d$; an input dot clock reproducing circuit 30 for reproducing an input dot clock DCK for the A/D conversion; an image display unit 50; an image display unit drive circuit 40 for converting the converted digital image signals $R_d$, $G_d$, and $B_d$ into signals R, G, and B which are suitable for the image display unit 50 and for generating drive timing pulses for driving the image display unit 50; a number of displayed pixels detecting circuit 60 for detecting the number of horizontal valid displayed pixels from the horizontal start-position and the horizontal end-position of the displayed image on the basis of the displayed image signals R, G, and B which are generated by the image display unit drive circuit 40 and a display horizontal synchronizing signal H, a display vertical synchronizing signal V, and a display dot-clock CK; and an input dot-clock reproducing control circuit 70. The image display apparatus can automatically adjust the dot clock by controlling a dividing number of the input dot clock reproducing circuit 30, based on information of the number of valid displayed pixels which is detected by the number of displayed pixels detecting circuit 60.

The number of displayed pixels detecting circuit 60 is disposed at the stage after the image display unit drive circuit 40, thereby enabling the operating speed of the number of displayed pixels detecting circuit 60 to be suppressed within a drive speed of the image display unit 50 and, further, integration with the image display unit drive circuit 40 to be easily realized by IC fabrication.

Figure 2:
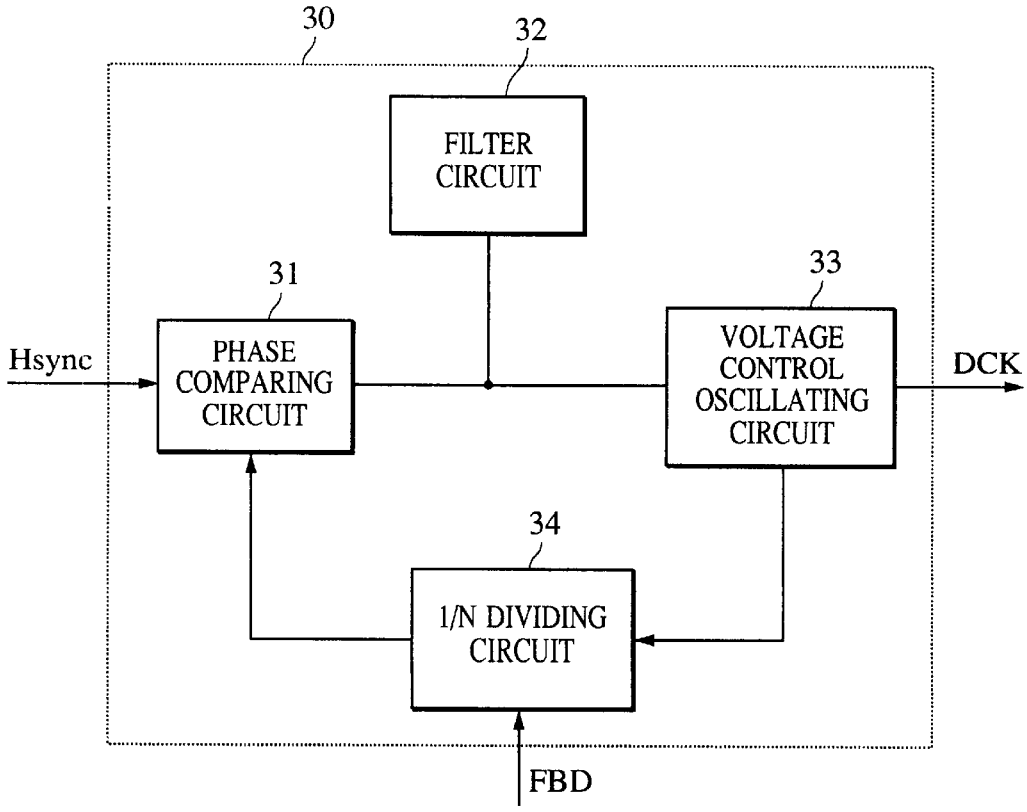
FIG. 2 is a block diagram showing the construction of an input dot clock reproducing circuit in the image display apparatus in FIG. 1.

As shown in FIG. 2, the input dot clock reproducing circuit 30 comprises a phase comparing circuit 31 for comparing the phase of an input horizontal synchronizing signal Hsync with the phase of an internal feed-back signal and for outputting an error signal, a filter circuit 32 for smoothing the output of the phase comparing circuit 31, a voltage controlled oscillating circuit 33 for controlling the oscillating frequency by an electric potential which is smoothed by the filter circuit 32, and a 1/N-dividing circuit 34 for dividing the oscillating signal of the voltage controlled oscillating circuit 33 by N and for generating the internal feed-back signal.

The phase comparing circuit 31 compares the input horizontal synchronizing signal Hsync with the signal which is obtained by dividing the input dot clock DCK which is reproduced by the voltage controlled oscillating circuit 33 by N by the 1/N-dividing circuit 34 and sets the difference to a control voltage of the voltage controlled oscillating circuit 33 through the filter circuit 32. The voltage controlled oscillating circuit 33 reproduces the input dot clock DCK so as to remove the difference from the phase comparing circuit 31. In this case, the input dot clock DCK is oscillated at a frequency having a number N of clocks for the period of the input horizontal synchronizing signal Hsync. Therefore, the input dot clock DCK having a desired frequency can be reproduced by adjusting the dividing number N of the 1/N-dividing circuit 34.

The image display unit drive circuit 40 has an image memory, and the converted digital image signals $R_d$, $G_d$, and $B_d$ are temporarily stored therein in response to the input dot clock DCK. Thereafter, the stored signals are read out in response to a clock having a frequency other than that of the input dot clock DCK and are converted so that the read-out signals have a number of pixels which coincide with the number of displayed pixels of the image display unit 50. For example, if the number of displayed pixels of the image display unit 50 is (1024×768) and the number of pixels of the input image signal is (800×600), the image display unit drive circuit 40 multiplies the input image signal by 1.28, so that the multiplied result coincides with the number of displayed pixels (1024×768) of the image display unit 50. Further, the image display unit drive circuit 40 generates drive timing pulses (a display horizontal synchronizing pulse H, a display vertical synchronizing pulse V, and a display dot-clock CK) of the image display unit 50 and inputs the image signals R, G, and B, which are processed by the image display unit drive circuit 40 in response to the timing pulses, to the image display unit 50, thereby displaying the image.

Figure 3:
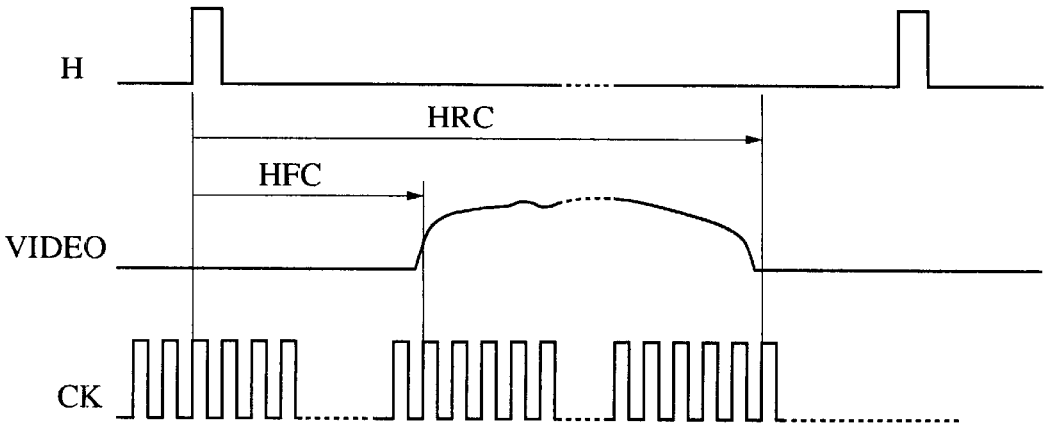
FIG. 3 is a timing chart showing one example of an image position for a horizontal synchronizing signal.

The display image signals R, G, and B, the display horizontal synchronizing signal H, the display vertical synchronizing signal V, and the display dot-clock CK which are outputted by the image display unit drive circuit 40 are inputted to the number of displayed pixels detecting circuit 60. The number of displayed pixels detecting circuit 60 has a counter for counting the display dot-clock CK in the horizontal direction synchronously with the display horizontal synchronizing signal H, and detects the number of display dot-clocks CK up until the point at which the display image signals R, G, and B are first detected and the number of display dot-clocks CK up until the point at which the display image signal ceases to exist, which are denoted as HFC and HRC, respectively, as shown in FIG. 3.

Figure 4:
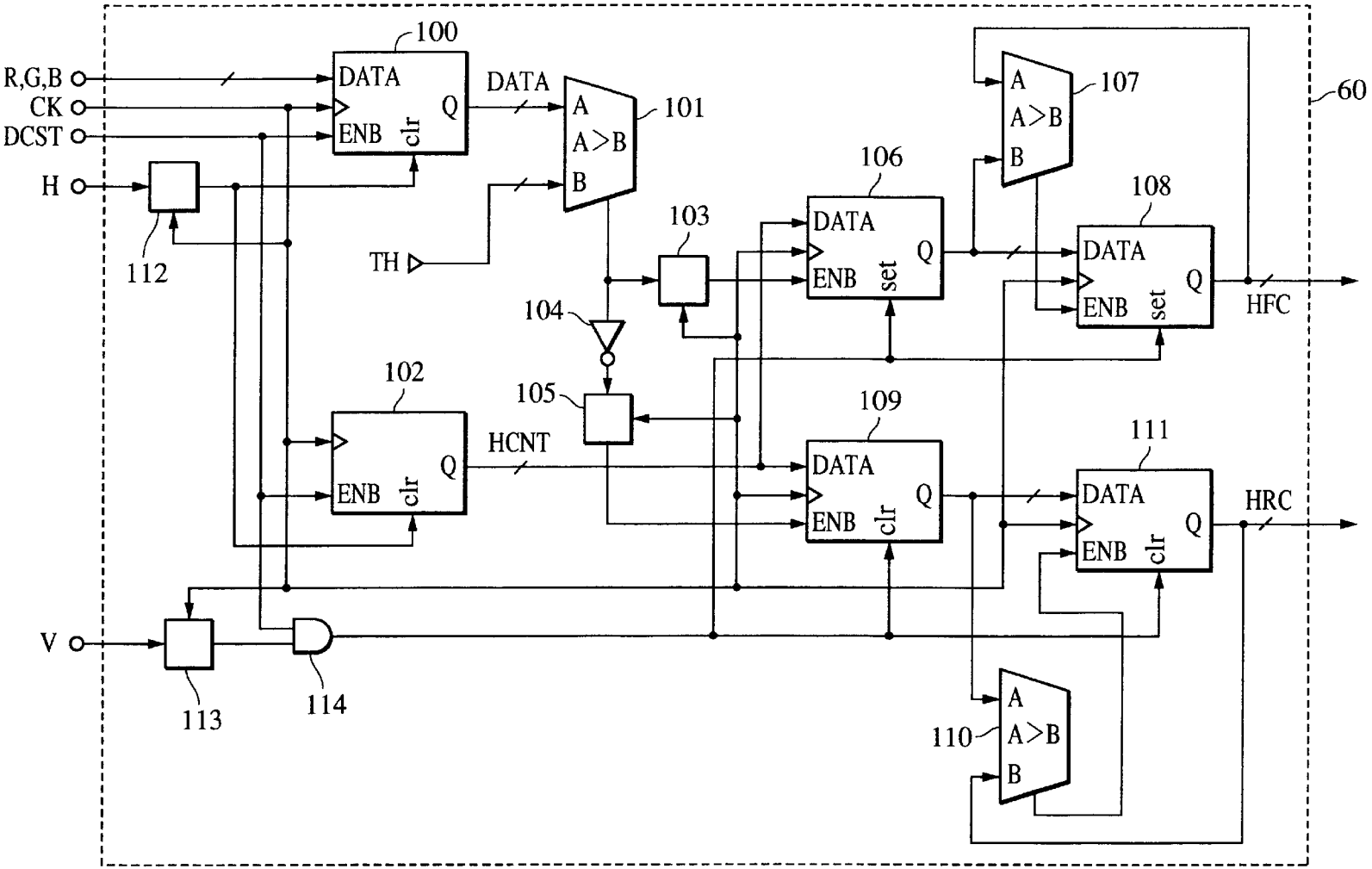
FIG. 4 is a block diagram showing the detailed construction of a detecting circuit of the number of displayed pixels in the image display apparatus in FIG. 1.

FIG. 4 shows the detailed construction of the number of displayed pixels detecting circuit 60 and the operation thereof is described hereinbelow. A one-clock-pulse forming circuit 112 changes the display horizontal synchronizing signal H to a pulse having a width of one clock, and a display image signal latch 100 and a display dot-clock counter 102 are cleared. A one-clock pulse forming circuit 113 changes the display vertical synchronizing signal V to a pulse having a width of one clock, and a high-level signal (High) is set in latches 106 and 108 and also latches 109 and 111 are cleared. The display dot-clock counter 102 is cleared synchronously with the display horizontal synchronizing signal H and, thereafter, counts the number of display dot-clocks CK. The display image signals R, G, and B are latched once by the latch 100 and are thereafter compared with a fixed value TH by a comparing circuit 101, thereby determining the presence or absence of the image. A value which is slightly larger than a black level of the image is set as the fixed value TH.

If the image signals R, G, and B have a valid image, the output of the comparing circuit 101 is set to the high level (High), is shaped to a pulse having a width of one clock by a one-clock pulse forming circuit 103, and becomes an enable signal of the latch 106. The latch 106 latches the number of counting times HCNT of the display dot-clock counter 102 in the enabled state. The number of counting times which is latched by the latch 106 is compared with a value which is latched by the latch 108 by a comparing circuit 107. If the value of the latch 106 is smaller than the value latched by the latch 108, the enable signal is outputted to the latch 108 and the number of counting times is latched in the latch 108. The operation is executed every horizontal line, thereby detecting the minimum number of counting times. The value in this case becomes the position information HFC which represents the initial position in an area where the image exists.

If the image signals R, G, and B have no valid image, the output of the comparing circuit 101 is set to the low level (Low), is shaped to a pulse having a width of one clock by a one-clock pulse forming circuit 105, and becomes an enable signal of the latch 109. The latch 109 latches a number of counting times HCNT of the display dot-clock counter 102 in the enabled state. The number of counting times which is latched by the latch 109 is compared with a value which is latched by a latch 111 by a comparing circuit 110. If the value of the latch 109 is larger than the value latched by the latch 111, the enable signal is outputted to the latch 111 and the number of counting times is latched to the latch 111. The operation is executed every horizontal line, thereby detecting the maximum number of counting times. The value in this case becomes the position information HRC which represents the final position in the area where the image exists. Incidentally, since the number of displayed pixels detecting circuit 60 does not need to always operate, a signal DCST is set as an enable control signal of the whole circuit.

The position information HFC and HRC which is detected by the number of displayed pixels detecting circuit 60 is inputted to the input dot-clock reproducing control circuit 70. As the inputted result, the control circuit 70 of the number of displayed pixels corrects the dividing number of the 1/N-dividing circuit 34 which is included in the input dot clock reproducing circuit 30 on the basis of an adjusting process, which will be described in detail hereinafter, and obtains a desired input dot clock.

Although, according to the present embodiment, the image signals which are inputted to the number of displayed pixels detecting circuit 60 are set as three colors of R, G, and B, in place thereof, the image signals may be simply set as one color of R, G, and B.

Figure 5:
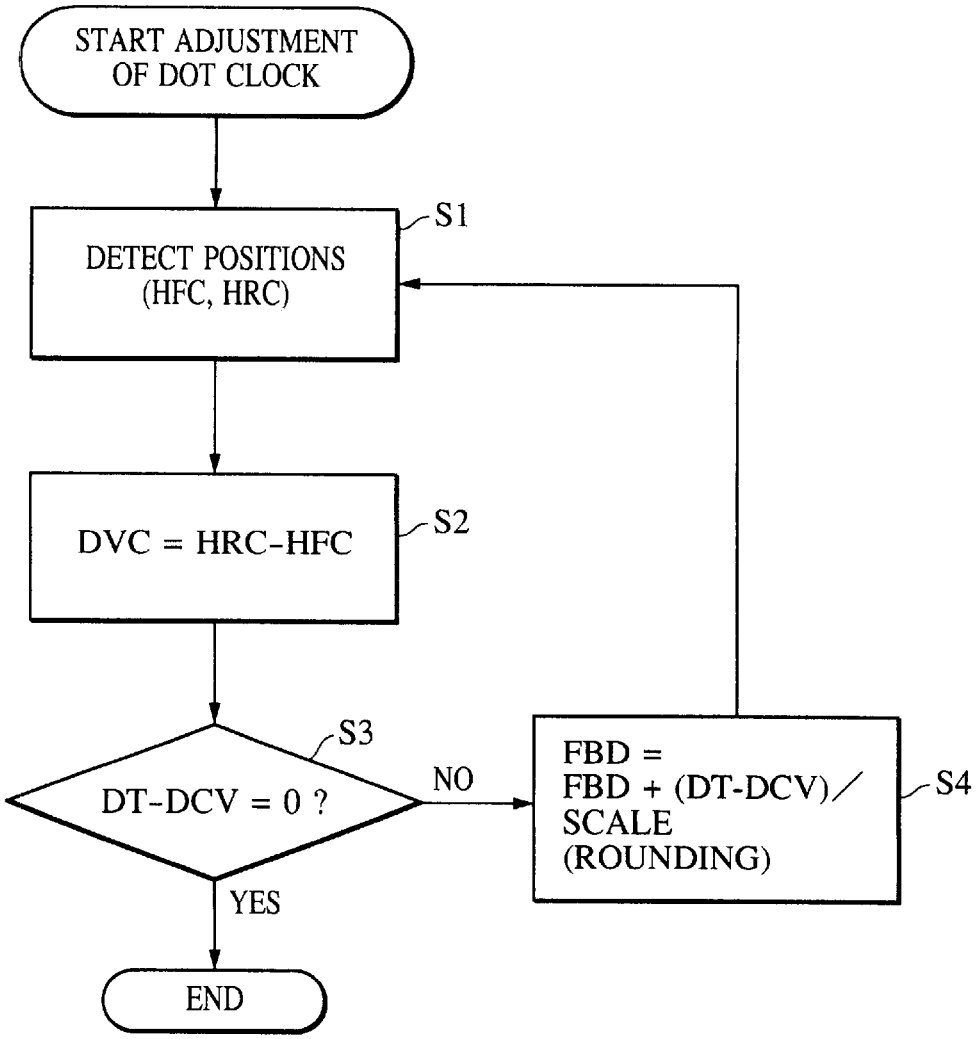
FIG. 5 is one flowchart showing an operation for adjusting an input dot clock in the image display apparatus in FIG. 1.

FIG. 5 shows one adjusting process of the input dot clock DCK in the image display apparatus. As shown in the figure, when the adjustment starts, the number of displayed pixels detecting circuit 60 detects in step S1 the position information HFC indicating the image start position and the position information HRC indicative of the image end position in the horizontal direction. Next, the number of horizontal valid displayed pixels DCV (=HRC−HFC) is calculated in step S2. The number of horizontal pixels DT of the image display unit 50 is compared with the number of horizontal valid displayed pixels DCV of the displayed-image signal in step S3, and if DT is not equal to DCV, the processing routine proceeds to step S4. A dividing number FBD of the 1/N-dividing circuit 34 constructing the input dot clock reproducing circuit 30 is corrected by the difference between the number of horizontal pixels DT in the image display unit 50 and the number of the horizontal valid displayed pixels DCV in step S4. The correction needs to take into account a scaling factor SCALE for enlargement/reduction for a resolution conversion which is processed in the image display unit drive circuit 40, and the value FBD=FBD+(DT−DCV)/SCALE is obtained. The processes in steps S1 to S4 are repeated until the dividing number FBD of the 1/N-dividing circuit 34 is corrected and the number of the horizontal pixels DT of the image display unit 50 is equal to the number of horizontal valid displayed pixels DCV. If it is determined that the number of horizontal pixels DT of the image display unit 50 is equal to the number of horizontal valid displayed pixels DCV, the adjusting process ends.

For example, if an SVGA resolution of the input image signal is (800×600) and the number of horizontal pixels DT of the image display unit 50 is 1024, the conversion scaling factor SCALE is equal to 1.28. In this case, assuming that the dividing number FBD is 1056 and the detected number of horizontal valid displayed pixels DCV is 1040, the value DT−DCV=−16 is obtained in step S3. Therefore, the processing routine proceeds to step S4. The value FBD=1056−16/1.28=1043.5 is obtained in step S4, so that FBD is equal to 1044 by rounding and the processing routine returns to step S1. The number of horizontal valid displayed pixels DCV is again detected in steps S1 and S2, and if DCV is equal to 1028, the value DT−DCV=−4 is obtained in step S3. Therefore, the processing routine proceeds to step S4 and the value FBD=1044−4/1.28 is rounded, thereby obtaining 1041. The processing routine returns to step S1. The number of horizontal valid displayed pixels DCV is again detected in steps S1 and S2, and if DCV is equal to 1025, the value DT−DCV=−1 is obtained in step S3. Therefore, the processing routine proceeds to step S4 and the value FBD=1041−1/1.28 is rounded, thereby obtaining 1040. The processing routine returns to step S1. Further, The number of valid display pixels is again detected in steps S1 and S2, and if DCV is equal to 1024, the value DT−DCV=0 is obtained in step S3. Therefore, the adjustment processing routine ends.

Figure 6:
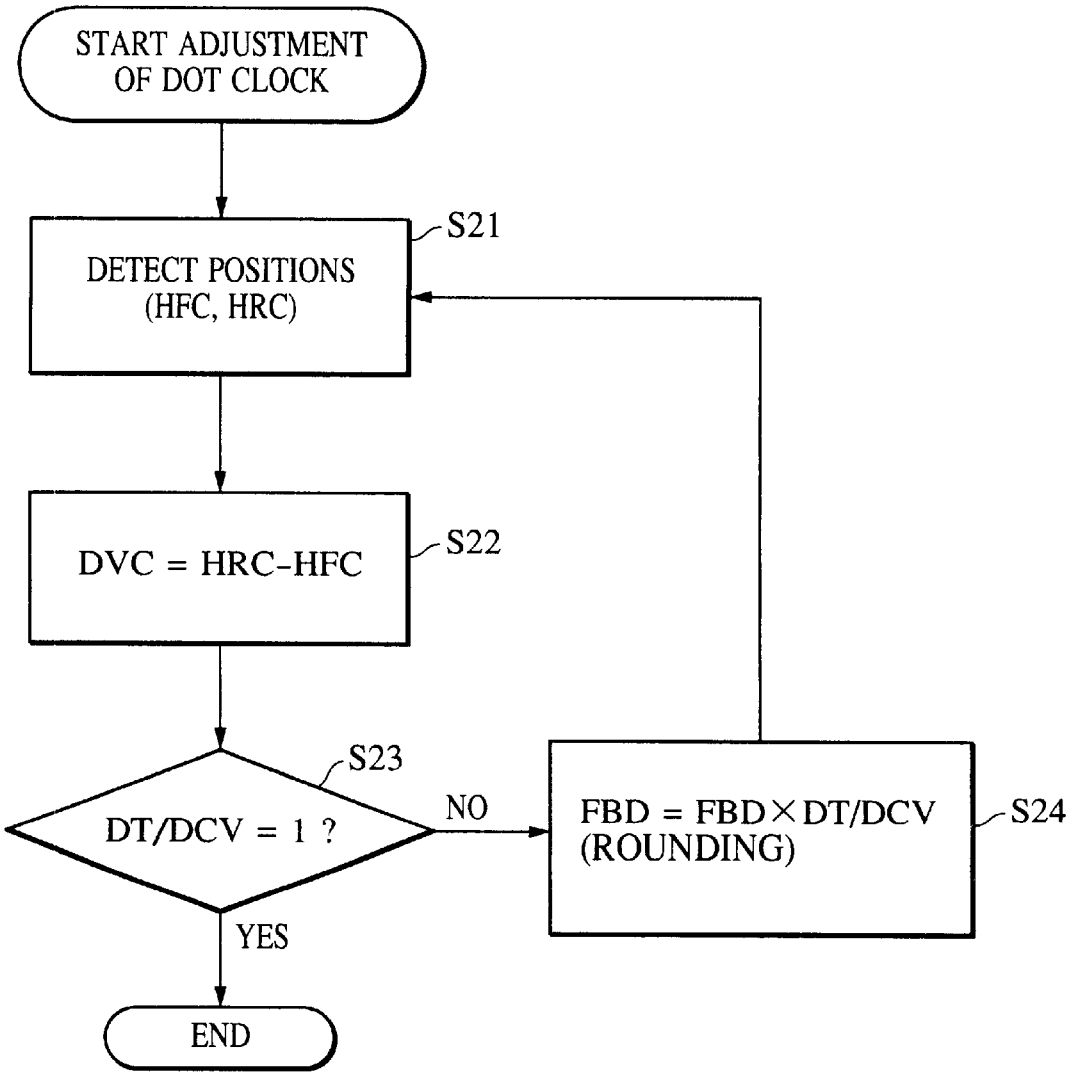
FIG. 6 is another flowchart showing the operation for adjusting the input dot clock in the image display apparatus in FIG. 1.
Figure 7:
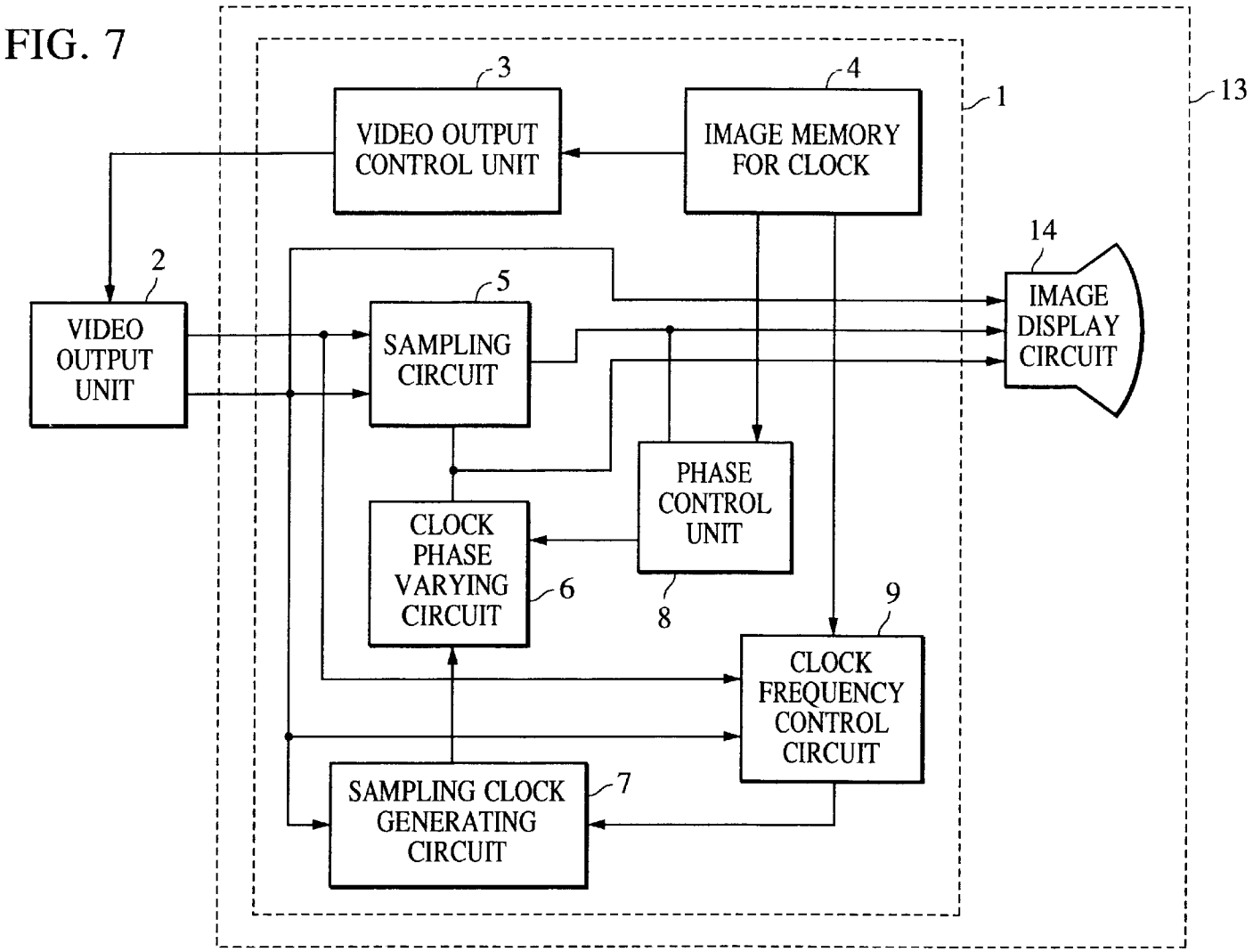
FIG. 7 is a block diagram showing a conventional example of an image display apparatus.

FIG. 6 shows another adjusting process of the input dot clock DCK in the image display apparatus in another embodiment of the present invention. When the adjustment starts, the number of displayed pixels detecting circuit 60 detects direction in step S21 the position information HFC indicating the image start position and the position information HRC indicating the image end position in the horizontal. Next, the number of horizontal valid displayed pixels DCV (=HRC−HFC) is calculated in step S22. A ratio DT/DCV of the number of horizontal pixels DT in the image display unit 50 to the number of horizontal valid displayed pixels DCV is calculated in step S23. If the ratio is not equal to 1, the processing routine proceeds to step S24. The dividing number FBD of the 1/N-dividing circuit 34 constructing the input dot clock reproducing circuit 30 is corrected by using the ratio DT/DCV of the number of horizontal pixels DT in the image display unit 50 to the number of horizontal valid displayed pixels DCV, thereby obtaining FBD=FBD×(DT/DCV) in step S24. The processes in steps S21 to S24 are repeated until the dividing number FBD of the 1/N-dividing circuit 34 is corrected and the number of the horizontal pixels DT of the image display unit 50 is equal to the number of horizontal valid displayed pixels DCV. If it is determined that the number of horizontal pixels DT of the image display unit 50 is equal to the number of horizontal valid displayed pixels DCV in the step S23, the adjustment process ends.

For example, the SVGA resolution of the input image signal is (800×600) and the number of horizontal pixels DT of the image display unit 50 is 1024. In this case, assuming that the dividing number FBD is 1056 and the detected number of horizontal valid displayed pixels DCV is 1040, the value DT/DCV≠1 is obtained in step S23. Therefore, the processing routine proceeds to step S24. The value FBD=1056×(1024/1040)=1039.8 is obtained in step S24, so that FBD is equal to 1040 by rounding and the processing routine returns to step S21. The number of horizontal valid displayed-pixels is again detected in steps S21 and S22, and if DCV is equal to 1024, the value DT/DCV=1 is obtained in step S23. Therefore, the adjustment processing routine ends.

As mentioned above, according to the present invention, the number of horizontal valid pixels of the display image signal is detected and, thereby, it can be determined whether or not the frequency of the input dot-clock is correct. If it is determined that the frequency of the input dot-clock is not correct, it is possible to realize the adjustment of the proper frequency of the input dot-clock so as to obtain a desired number of horizontal valid pixels by correcting the dividing number of the input dot clock reproducing circuit by a difference between the detected number of horizontal valid pixels and the number of pixels of the image display unit.

The number of horizontal valid pixels detecting circuit is disposed at the stage after the image display unit drive circuit and, thereby, the operating speed of the number of horizontal valid pixels detecting circuit can become constant irrespective of the frequency of the input dot-clock. Further, an IC can be realized to include the image display unit drive circuit, thereby enabling the reduction of costs.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image display apparatus for displaying an image on a dot-matrix type image display unit on the basis of an input image signal of an arbitrary standard, said apparatus comprising:

input dot clock reproducing means for reproducing an input dot clock on the basis of an input horizontal synchronizing signal of the input image signal;

A/D converting means for converting the input image signal into a digital signal in response to the reproduced input dot clock;

image display means drive circuit for converting the digital signal into a display signal which is suitable for display by the image display unit and generating a drive timing signal for the display;

a number of horizontal valid pixels detecting circuit for detecting the number of horizontal valid pixels of the display signal on the basis of the display signal and the drive timing signal; and an input dot clock control circuit for controlling a frequency of the input dot clock so that the number of horizontal valid pixels is equal to a desired value.

2. An apparatus according to claim 1, wherein said image display means drive circuit comprises an image memory for temporarily storing the digital signal and generates a display horizontal synchronizing signal, a display vertical synchronizing signal, and a display dot-clock as the drive timing signals.

3. An apparatus according to claim 1, wherein said image display means drive circuit converts the digital signal into the display signal so that the numbers of horizontal and vertical pixels of the digital signal coincide with the numbers of horizontal and vertical pixels of the image display unit.

4. An apparatus according to claim 1, wherein said input dot clock reproducing circuit comprises:

a phase comparing circuit for comparing a phase of the input horizontal synchronizing signal with a phase of an internal feed-back signal and outputting an error signal;

a filter circuit for smoothing the output of the phase comparing circuit;

a voltage controlled oscillating circuit for controlling an oscillating frequency by an electric potential which is smoothed by the filter circuit; and an 1/N-dividing circuit for 1/N-dividing the oscillating signal of said voltage controlled oscillating circuit, thereby generating the internal feed-back signal.

5. An apparatus according to claim 4, wherein said input dot clock control circuit obtains the desired number of horizontal valid pixels by controlling a dividing number N of said 1/N-dividing circuit.

6. An apparatus according to claim 1, wherein said number of horizontal valid pixels detecting circuit detects a horizontal start position of the display signal as a number of displayed dot-clocks until a valid display image signal is detected for each display horizontal scanning period and also detects a horizontal end position of the display signal as the number of displayed dot-clocks until the valid display image signal is not detected for each display horizontal scanning period.

7. An apparatus according to claim 1, wherein said input dot clock control circuit comprises a CPU.

8. A horizontal valid pixels detecting apparatus comprising:

a dot clock counting circuit for starting counting of a number of dot clocks for an inputted image signal synchronously with a horizontal synchronizing signal of the image signal;

a level detecting circuit for detecting whether or not there is a valid image signal in the image signal;

a horizontal image start-position latching circuit for latching a minimum counted number of the dot clocks until the valid image signal is detected for each horizontal scanning period of the image signal; and a horizontal image end-position latching circuit for latching a maximum counted number of the dot clocks until the valid image signal is not detected for each horizontal scanning period of the image signal.

9. An image display method for displaying an input image signal on an image display unit by use of a display dot-clock by sampling the input image signal at an input dot clock and by converting the signal into a display signal suitable for display on the image display unit, said method comprising the steps of:

detecting horizontal start and end positions of a valid signal in the converted display signal as numbers of displayed dot-clocks until the valid display signal is detected and is not detected, respectively, for each display horizontal scanning period; and controlling a frequency of the input dot clock so that the number of horizontal valid pixels which is obtained on the basis of the detected result is equal to a desired value.

10. A method according to claim 9, further comprising the steps of:

generating the input dot clock by an input dot clock reproducing circuit for generating a dot clock by converting an input horizontal synchronizing signal of the input image signal into a signal of a frequency corresponding to a set dividing value; and controlling the frequency of the input dot clock by adding a difference between the number of horizontal valid pixels which is obtained on the basis of the detected result and the desired number of horizontal valid pixels to the dividing set value.

11. A method according to claim 9, further comprising the steps of:

generating the input dot clock by an input dot clock reproducing circuit for generating a dot clock by converting an input horizontal synchronizing signal of the input image signal into a signal of a frequency corresponding a set dividing value; and controlling a frequency of the input dot clock by multiplying the set dividing value by a ratio of the number of horizontal valid pixels which is obtained on the basis of the detected result to the desired number of horizontal valid pixels.

12. A method for displaying an image on a dot- matrix type image display unit on the basis of an input image signal of an arbitrary standard, said method comprising the steps of:

reproducing an input dot clock on the basis of an input horizontal synchronizing signal of the input image signal;

converting the input image signal into a digital signal in response to the reproduced input dot clock;

converting the digital signal into a display signal which is suitable for display by the image display unit and generating a drive timing signal for the display;

detecting the number of horizontal valid pixels of the display signal on the basis of the display signal and the drive timing signal; and controlling a frequency of the input dot clock so that the number of horizontal valid pixels is equal to a desired value.

13. A method according to claim 12, further comprising the steps of temporarily storing the digital signal, and generating a display horizontal synchronizing signal, a display vertical synchronizing signal, and a display dot-clock as the drive timing signals.

14. A method according to claim 12, further comprising the step of converting the digital signal into the display signal so that the numbers of horizontal and vertical pixels of the digital signal coincide with the numbers of horizontal and vertical pixels of the image display unit.

15. A method according to claim 12, further comprising the steps of:

comparing a phase of the input horizontal synchronizing signal with a phase of an internal feed-back signal and outputting an error signal;

smoothing the output of the phase comparing circuit;

controlling an oscillating frequency by an electric potential which is smoothed by the filter circuit; and 1/N-dividing the oscillating signal circuit, thereby generating the internal feed-back signal.

16. A method according to claim 15, wherein the desired number of horizontal valid pixels is obtained by controlling a dividing number N.

17. A method according to claim 12, further comprising the steps of detecting a horizontal start position of the display signal as a number of displayed dot-clocks until a valid display image signal is detected for each display horizontal scanning period, and also detecting a horizontal end position of the display signal as the number of displayed dot- clocks until the valid display image signal is not detected for each display horizontal scanning period.

* * * * *

UNITED STATES PATENT AND TRADEMARK OFFICE

CERTIFICATE OF CORRECTION

PATENT NO. : 6,556,191 B1
DATED : April 29, 2003
INVENTOR(S) : Akihiro Ouchi

It is certified that error appears in the above-identified patent and that said Letters Patent is hereby corrected as shown below:

Title page,
After *Primary Examiner*, insert the following:

-- [74] *Attorney, Agent, or Firm*—Fitzpatrick, Cella, Harper & Scinto --.

Drawings,
Sheet 1, FIG. 1, "PIXELES" should read -- PIXELS --.

Column 10,
Line 4, "an" should read -- a --.

Column 11,
Line 13, "dot- matrix" should read -- dot-matrix --.

Column 12,
Line 30, "dot- clocks" should read -- dot-clocks --.

Signed and Sealed this

Ninth Day of March, 2004

JON W. DUDAS
*Acting Director of the United States Patent and Trademark Office*